US006361423B2

(12) United States Patent
Gurusamy et al.

(10) Patent No.: US 6,361,423 B2
(45) Date of Patent: Mar. 26, 2002

(54) CHEMICAL MECHANICAL POLISHING CONDITIONER

(75) Inventors: Jayakumar Gurusamy, Mountain View; Lawrence M. Rosenberg, San Jose, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/746,710

(22) Filed: Dec. 22, 2000

Related U.S. Application Data

(62) Division of application No. 09/052,798, filed on Mar. 31, 1998, now Pat. No. 6,200,199.

(51) Int. Cl.[7] ..... B24B 21/18

(52) U.S. Cl. ..... 451/443; 451/444; 451/56

(58) Field of Search ..... 451/56, 72, 443, 451/444, 442, 540, 548, 550, 490, 494

(56) References Cited

U.S. PATENT DOCUMENTS

| | | | | |
|---|---|---|---|---|
| 3,932,966 | A | | 1/1976 | Stern |
| 4,481,741 | A | | 11/1984 | Bouladon et al. |
| 5,081,051 | A | | 1/1992 | Mattingly et al. |
| 5,216,843 | A | | 6/1993 | Breivogel et al. |
| 5,245,796 | A | | 9/1993 | Miller et al. |
| 5,259,085 | A | | 11/1993 | Marafante et al. |
| 5,423,558 | A | | 6/1995 | Koeth et al. |
| 5,433,650 | A | | 7/1995 | Winebarger |
| 5,456,627 | A | | 10/1995 | Jackson et al. |
| 5,486,131 | A | | 1/1996 | Cesna et al. |
| 5,569,062 | A | | 10/1996 | Karlsrud |
| 5,575,707 | A | | 11/1996 | Talieh et al. |
| 5,667,443 | A | * | 9/1997 | Mallon ..... 451/443 |
| 5,683,289 | A | * | 11/1997 | Hempel, Jr. ..... 451/443 |
| 5,738,574 | A | | 4/1998 | Tolles et al. |
| 5,762,544 | A | | 6/1998 | Zuniga et al. |
| 5,804,507 | A | | 9/1998 | Perlov et al. |
| 5,913,714 | A | | 6/1999 | Volodarsky et al. |
| 5,957,751 | A | | 9/1999 | Govzman et al. |
| 6,019,670 | A | | 2/2000 | Cheng et al. |
| 6,033,290 | A | | 3/2000 | Gurusamy et al. |
| 6,036,583 | A | | 3/2000 | Perlov et al. |
| 6,036,587 | A | | 3/2000 | Tolles et al. |
| 6,080,050 | A | | 6/2000 | Chen et al. |
| 6,200,199 | B1 | * | 5/2001 | Gurusamy et al. ..... 451/444 |

FOREIGN PATENT DOCUMENTS

| | | |
|---|---|---|
| EP | 0 774 323 | 5/1997 |
| EP | 0 868 976 | 10/1998 |
| WO | WO 96/36459 | 11/1996 |

* cited by examiner

*Primary Examiner*—Derris H. Banks
(74) *Attorney, Agent, or Firm*—Fish & Richardson

(57) ABSTRACT

A conditioner head for conditioning the polishing surface of a polishing pad. The conditioner head includes a drive element carried for rotation about a longitudinal axis and a disk backing element. The disk backing element carries an abrasive disk and holds the lower surface of the disk in engagement with the polishing pad. The conditioner head further includes a driven element coupling the disk backing element to the drive element to transmit torque and rotation therebetween. The driven element is longitudinally movable between retracted and extended positions. An annular diaphragm spans a gap between the drive element and the driven element and is coupled to the drive element and to the driven element to rotate therewith as a unit.

11 Claims, 13 Drawing Sheets

CHEMICAL MECHANICAL POLISHING CONDITIONER

This application is a division of U.S. application Ser. No. 09/052,798, filed Mar. 31, 1998, now U.S. Pat. No. 6,200,199 B1, which is incorporated herein by reference.

BACKGROUND

1. Technical Field

This invention relates generally to the planarization of semiconductor substrates and, more particularly to the conditioning of polishing pads in slurry-type polishers.

2. Background Information

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively less planar. This non-planar outer surface presents a problem for the integrated circuit manufacturer as a non-planar surface can prevent proper focusing of the photolithography apparatus. Therefore, there is a need to periodically planarize the substrate surface to provide a planar surface. Planarization, in effect, polishes away a non-planar, outer surface, whether a conductive, semiconductive, or insulative layer, to form a relatively flat, smooth surface.

Chemical mechanical polishing is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: substrate surface planarity and uniformity, and the polishing rate. Inadequate planarity and uniformity can produce substrate defects. The polishing rate sets the time needed to polish a layer. Thus, it sets the maximum throughput of the polishing apparatus.

It is important to take appropriate steps to counteract any deteriorative factors which either present the possibility of damaging the substrate (such as by scratches resulting from accumulated debris in the pad) or reduce polishing speed and efficiency (such as results from glazing of the pad surface after extensive use). The problems associated with scratching the substrate surface are self-evident. The more general pad deterioration problems both decrease polishing efficiency, which increases cost, and create difficulties in maintaining consistent operation from substrate to substrate as the pad decays.

The glazing phenomenon is a complex combination of contamination, thermal, chemical and mechanical damage to the pad material. When the polisher is in operation, the pad is subject to compression, shear and friction producing heat and wear. Slurry and abraded material from the wafer and pad are pressed into the pores of the pad material and the material itself becomes matted and even partially fused. These effects reduce the pad's roughness and its ability to apply fresh slurry to the substrate.

It is, therefore, desirable to continually condition the pad by removing trapped slurry, and unmatting or re-expanding the pad material.

A number of conditioning procedures and apparatus have been developed. Common are mechanical methods wherein an abrasive material is placed in contact with the moving polishing pad. For example, a diamond coated screen or bar may be used which scrapes and abrades the pad surface, and both removes the contaminated slurry trapped in the pad pores and expands and re-roughens the pad.

SUMMARY

In one aspect, the invention is directed to a conditioner head for conditioning the polishing surface of a polishing pad. The head includes a drive element carried for rotation about a longitudinal axis. The head further includes a disk backing element for carrying an abrasive disk and holding the lower surface of the disk in engagement with the polishing pad. A driven element couples the disk backing element to the drive element and transmits torque and rotation therebetween. The driven element is longitudinally movable between retracted and extended positions. An annular diaphragm spans a gap between the drive element and the driven element and is coupled to the drive element and the driven element so as to rotate therewith as a unit.

Implementations of the invention may include one or more of the following. The diaphragm may in part bound a pressure chamber which may be pressurized to shift the driven element from the retracted position to the extended position and depressurized to shift the driven element from the extended position to the retracted position. During transition between the retracted and extended positions a first surface of the diaphragm, exterior to the pressure chamber, rolls of a generally annular outer surface portion of the driven element traverses the gap and rolls onto a generally annular inner surface portion of the drive element.

The drive element may include a drive shaft and a collar substantially fixed to the drive shaft and having a generally annular inner surface portion. The driven element may include a drive sleeve encircling at least a length of the drive shaft and having a generally annular outer surface portion. The annular diaphragm may extend between an outer periphery and an inner aperture and may be sealingly secured along the outer periphery to the collar and along the inner aperture to the drive sleeve. The generally annular outer surface portion of the drive sleeve may be a circular cylinder and the generally annular inner surface portion of the collar may be a circular cylinder. The diaphragm may in part bound a pressure chamber. The pressure chamber may be pressurized to shift the drive sleeve from the retracted position to the extended position and depressurized to shift the drive sleeve from the extended position to the retracted position. During transition between the retracted and extended positions, a first surface of the diaphragm, exterior to the pressure chamber, may roll off the generally annular outer surface portion of the drive sleeve. The first surface of the diaphragm may then traverse a gap between the generally annular outer surface portion of the drive sleeve and the generally annular inner surface portion of the collar and roll onto the generally annular inner surface portion of the collar. A fluid for inflating the pressure chamber may be introduced to the pressure chamber through a channel in the drive shaft. The head may include a housing substantially rigidly coupled to a conditioner arm for moving the head at least transverse to the longitudinal axis. The housing may include a first portion encircling at least the length of the collar, which first portion is coupled to the collar by a bearing system for permitting the collar to rotate relative to the first portion about the longitudinal axis. A web may be formed at the upper end of the drive shaft, the collar depending from the web. A pulley may be substantially fixed to the web for transmitting torque to the drive shaft. The collar may comprise a first piece depending from and fixed to the web and a second piece, separately formed from the first piece. The second piece may engage the bearing system and the diaphragm may be secured along the outer periphery to the collar between the first and second pieces. The diaphragm may be partially sandwiched between an outer cylindrical surface of an annular lip depending from the first piece and a generally annular inner surface of the second piece which forms the generally annular inner surface portion of the collar.

In another aspect, the invention is directed to a disk holder for holding a conditioning disk for conditioning a polishing pad. The disk holding element has a lower face for engaging an upper surface of the conditioning disk. The disk holding element defines a plurality of generally radially outward extending channels along the upper surface of the conditioning disk.

Implementations of the invention may include one or more of the following. The disk may comprise a central region, an outer perimeter, a plurality of radially extending spokes, and a plurality of webs. The spokes may extend from the central region to the outer perimeter, each spoke having a lower surface for engaging the upper surface of the conditioning disk. The webs, one such web between each adjacent pair of spokes, may each have a lower surface at least partially vertically recessed from the lower surfaces of the adjacent spokes so as to define one channel. Each web may extend from the central region and terminate at an outboard edge, radially recessed from the outer perimeter. The outer perimeter may be formed as a rim having a plurality of radially extending passageways. Each passageway may be generally aligned with an associated channel for permitting flow radially outward through the passageway from the associated channel when the disk holding element and disk are rotated about a central longitudinal axis while at least a lower surface of the disk is exposed to a liquid. Each of the radially extending passageways may be formed as a downwardly extending recess in the rim. The conditioning disk may be readily securable to and removable from the disk holding element. Each spoke may carry a magnet for attracting the conditioning disk. The conditioning disk may be readily securable to and removable from the disk holder element and the disk holder element may be readily securable to and removable from a rotating fixture. Each spoke may carry a magnet for securing the conditioning disk to the disk holder element and for securing the disk holder element to the rotating fixture. A first pin may depend from a first spoke and a second pin may depend from a second spoke, the first and second pins receivable by the conditioning disk for preventing rotation of the conditioning disk relative to the disk holder element. The central region, outer perimeter, plurality of radially extending spokes, and plurality of webs may be unitarily formed as a single piece of material. Each spoke may have a relatively narrow section extending outward from the central region and joining a relatively wider section adjacent the outer perimeter. Each web may have an upper surface substantially coplanar with the upper surfaces of adjacent spokes.

In another aspect, the invention is directed to a disk holder element for holding a conditioning disk used in association with a conditioner head of an apparatus for conditioning the polishing surface of a polishing pad. The disk holder element includes a lower surface magnetically engageable with an upper surface of the disk and an upper surface magnetically engageable with a lower surface of the head. The disk holder element may comprise a plurality of magnets securing the disk to the disk holder element and securing the disk holder element to the conditioner head.

In another aspect, the invention is directed to a conditioner head for conditioning the polishing surface of the polishing pad. The head includes a generally circular abrasive disk having upper and lower surfaces. The lower surface defining a disk plane. A drive element is carried for rotation about a longitudinal axis. A disk backing element carries the disk and holds the lower surface of the disk in engagement with the polishing pad and applies force and torque to the disk. The disk backing element has an upper member, fixed to the drive element, which upper member has a central downward facing socket having a spherical surface portion. The disk backing element further includes a lower member, fixed to the abrasive disk, which lower membrane has a central upward facing projection with a spherical surface portion in sliding engagement with the spherical surface portion of the socket. The disk backing element further includes at least one resilient member, coupling the upper member to the lower member so as to bias the lower member toward a neutral orientation. In the neutral orientation the disk plane is perpendicular to longitudinal axis. The resilient member permits tilting of the disk plane relative to the longitudinal axis and permits transmission of torque and rotation from the drive element to the disk. The upper member may comprises a central hub. The at least one resilient member may comprise a plurality of radially extending spokes extending radially outward from the central hub. Each spoke may be upwardly and downwardly flexible for permitting tilting of the disk plane relative to the longitudinal axis while transmitting rotation from the drive element to the rim. The spherical surface portions of the socket and projection may have a common center lying substantially within the disk plane.

In another aspect, the invention is directed to a conditioner head for conditioning the polishing surface of a polishing pad using an abrasive conditioning disk. The conditioner includes a drive element carried for rotation about a longitudinal axis and a disk backing element for holding and applying torque to the abrasive conditioning disk. The disk backing element includes a central hub fixed to the drive element, an outer rim generally defining a rim plane, and a plurality of radially extending spokes. The spokes extend from the central hub to the outer rim. Each spoke is upwardly and downwardly flexible for permitting tilting of the rim plane relative to the longitudinal axis while transmitting rotation from the drive element to the rim. Each spoke may have a transversely extending wave for increasing the flexibility of the spoke. The spokes may be formed of steel. The head may further comprise a plate having a central upward facing projection having a spherical surface portion. The hub may have a central downward facing socket having a spherical surface portion in sliding engagement with the spherical surface portion of the projection.

In another aspect, the invention is directed to a process for conditioning a polishing pad. The process includes providing an abrasive conditioning disk carried by a disk carrier and having a lower surface engageable with a polishing surface of the polishing pad. The carrier is caused to rotate the conditioning disk and bring the lower surface of the conditioning disk into engagement with the polishing surface of the polishing pad. The carrier is caused to reciprocate in the path along the rotating polishing pad. A carrier is caused to disengage the conditioning disk form the polishing pad. The carrier is caused to rotate the conditioning disk and introduce the conditioning disk to a body of cleaning liquid so as to cause a flow of the cleaning liquid longitudinally upward from the lower surface of the conditioning disk, through the conditioning disk, and radially outward along an upper surface of the conditioning disk so as to clean the conditioning disk.

Implementations of the inventive process may include on or more of the following. A second liquid may be applied to the polishing surface of the polishing pad. The second liquid may be permitted to flow up through the lower surface of the conditioning disk, through the conditioning disk, and radially outward along the upper surface of the conditioning disk when the conditioning disk is engaged with the polishing surface of the polishing pad. The flow of the cleaning liquid along the upper surface of the conditioning disk may be through a plurality of generally radially outwardly extending channels defined by a disk holder.

Among the advantages which may be provided by the invention are improved sealing and reduced wear and particle generation. Since the diaphragm may be fixed at its inner aperture and outer periphery to the associated elements, it need not be in sliding engagement with those elements either during rotation or in translation of the end effector between retracted and extended positions. This lack of sliding engagement reduces wear and the associated particle generation between slidingly engaged surfaces and prevents contaminants from entering the pressure chamber between slidingly engaged surfaces.

Further advantages are provided by the end effector featuring a spoked flexure and spherical socket and projection joint. The joint permits the application of downward force from the head to the conditioning disk to maintain compression between the conditioning disk and polishing pad surface. The flexure transmits torque and rotation to the disk while permitting the disk plane to tilt relative to the axis of rotation allowing the disk to remain flat against the polishing pad during conditioning. The flexure may bias the disk into a neutral orientation with the disk plane substantially perpendicular to the axis of rotation. By forming the flexure with a plurality of thin flat spokes, a balance is achieved between the ability to transmit torque about the axis of rotation and the ability to flex to allow the disk plane to tilt relative to the axis of rotation. The sliding spherical surface joint, with a center of rotation located in the center of the lower surface of the disk, also allows for smooth tilting of the disk during operation.

Further advantages are provided by a disk holding element which defines a plurality of channels along the upper surface of the disk so that during conditioning of the pad or during rinsing of the disk, there is a flow of either slurry or cleaning fluid upward through the bottom surface of the disk, through the disk, and radially outward along the upper surface of the disk through the channels. The channels facilitate more efficient conditioning and cleaning of the disk.

A further advantage is provided by a disk holding element which is made readily removable from the backing element and from the disk. The holding element may first be secured to the disk and then the combined holding element and disk may be secured to the backing element. Alignment features on the disk holding element facilitate the precise registration of the disk and holder relative to the backing element without undue effort. To allow faster changeout and thus reduce downtime when a disk is replaced, while one disk is in the conditioning head, a fresh disk can be secured to a second disk holding element. The first disk and first holder may be removed from the head, and replaced with a second disk and second holding element and the conditioner restarted. The first disk may then be separated from the first disk holding element and the first disk holding element secured to a new disk to await subsequent use.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference numbers and designations in the various drawings indicate like elements.

DETAILED DESCRIPTION

Figure 1A:
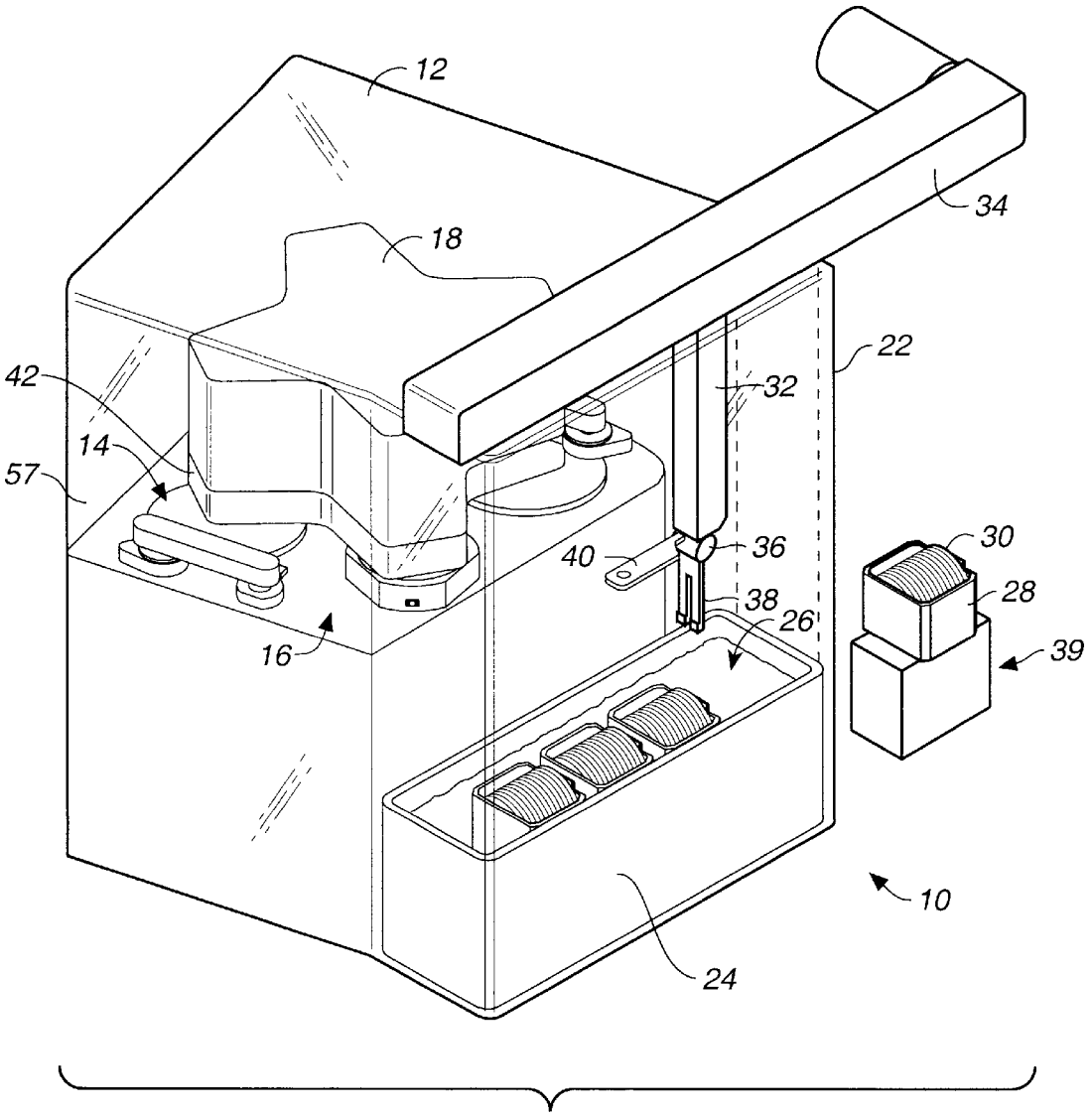
FIG. 1A is a perspective view of a polishing apparatus.
Figure 1B:
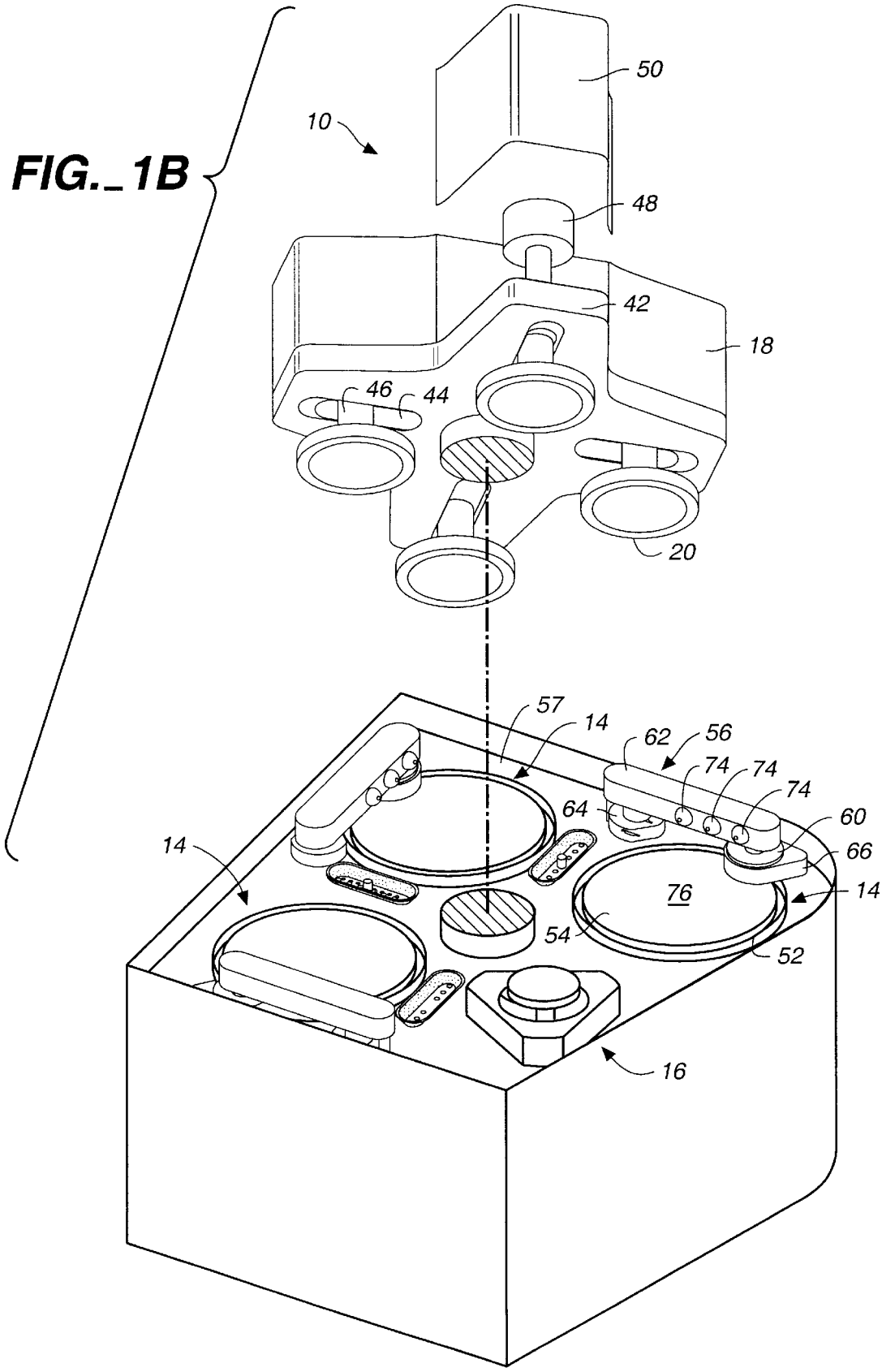
FIG. 1B is a partially exploded view of the polishing apparatus of FIG. 1.

Referring to FIGS. 1A and 1B, a polishing apparatus 10 includes a housing 12 that contains three independently-operated polishing stations 14, a substrate transfer station 16, and a rotatable carousel 18 which choreographs the operation of four independently rotatable carrier heads 20. Attached to one side of the housing 12 is a substrate loading apparatus 22 that includes a tub 24 that contains a liquid bath 26 in which cassettes 28 containing substrates 30 are immersed. An arm 32 rides along a linear track 34 and supports a wrist assembly 36, which includes a cassette claw 38 for moving cassettes 28 from a holding station 39 into the tub 24 and a substrate blade 40 for transferring substrates from the tub 24 to the transfer station 16.

The carousel 18 has a support plate 42 with slots 44 through which shafts 46 of the carrier heads 20 extend. The carrier heads 20 can independently rotate and oscillate back-and-forth in the slots 44 to achieve a uniformly polished substrate surface. The carrier heads 20 are rotated by respective motors 48, which are normally hidden behind removable sidewalls 50 of the carousel 18. In operation, a substrate is loaded from the tub 24 to the transfer station 16, from which the substrate is transferred to a carrier head 20. The carousel 18 then transfers the substrate through a series of one or more polishing stations 14 and finally returns the polished substrate to the transfer station 16.

Each polishing station 14 includes a rotatable platen 52, which supports a polishing pad 54, and a pad conditioner 56. The platen 52 and conditioner 56 are both mounted to a table top 57 inside the polishing apparatus 10. Each pad conditioner 56 includes a conditioner head 60, an arm 62, and a base 64. The arm 62 has a distal end coupled to the conditioner head 60 and a proximal end coupled to the base 64, which sweeps the conditioner head 60 across the polishing pad surface 76 to condition the surface 76 by abrading the surface to remove contaminants and retexturize the surface. Each polishing station 14 also includes a cup 66, which contains a cleaning liquid for rinsing or cleaning the conditioner head 60.

Figure 2A:
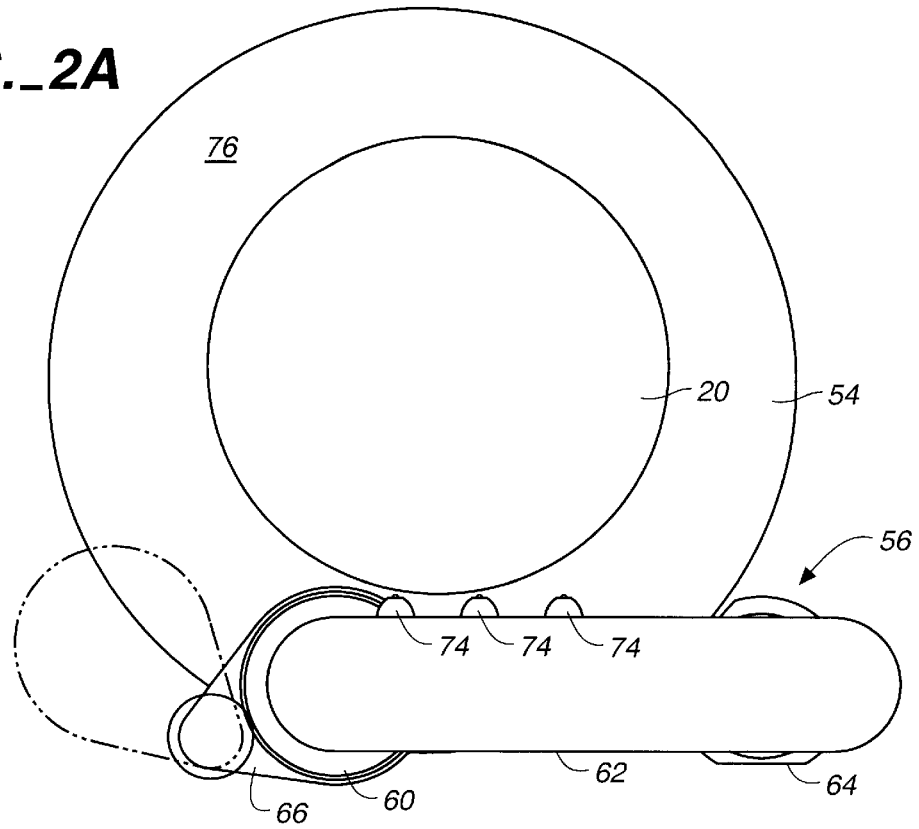
FIGS. 2A and 2B are diagrammatic top views of a substrate being polished and a polishing pad being conditioned by the polishing apparatus of FIG. 1.
Figure 2B:
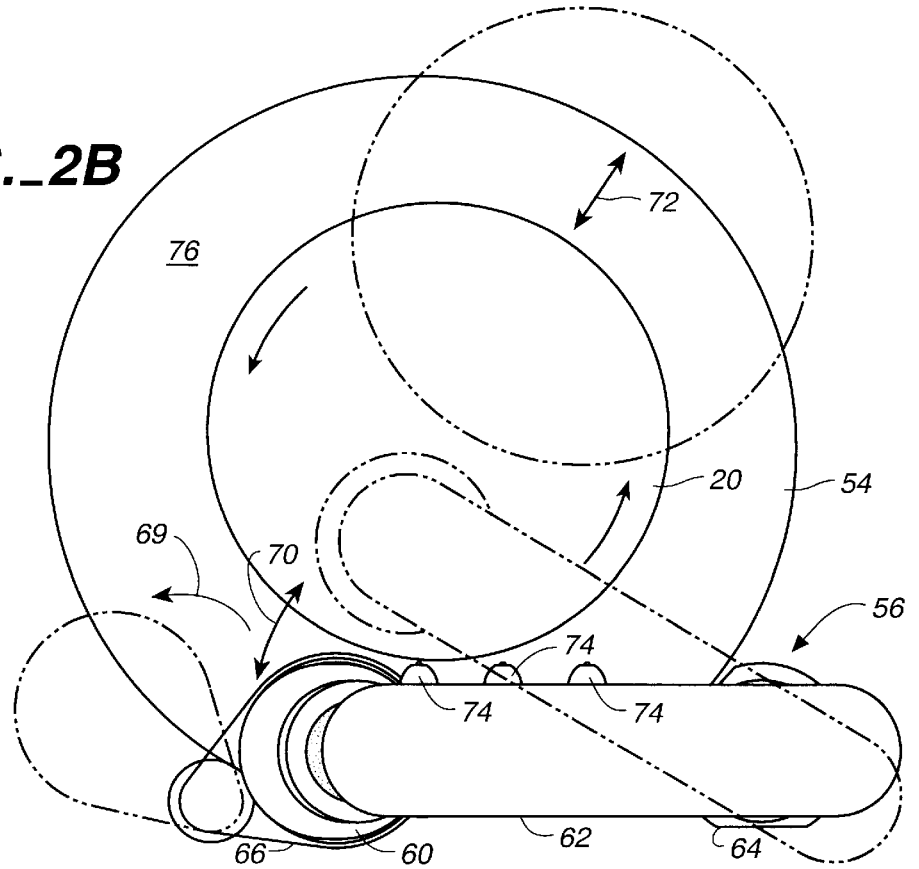

Referring to FIGS. 2A and 2B, in one mode of operation, a polishing pad 54 is conditioned by a pad conditioner 56 while the polishing pad polishes a substrate which is mounted on a carrier head 20. The conditioner head 60 sweeps across the polishing pad 54 with a reciprocal motion that is synchronized with the motion of the carrier head 20 across the polishing pad 54. For example, a carrier head 20 with a substrate to be polished may be positioned in the center of the polishing pad 54 and conditioner head 60 may be immersed in the cleaning liquid contained within the cup 66. During polishing, the cup 66 may pivot out of the way as shown by arrow 69, and the conditioner head 60 and the carrier head 20 carrying a substrate may be swept back-and-forth across the polishing pad 54 as shown by arrows 70 and 72, respectively. Three water jets 74 may direct streams of water toward the polishing pad 54 to rinse slurry from the polishing or upper pad surface 76.

For further details regarding the general features and operation of polishing apparatus 10, please refer to co-pending application Ser. No. 08/549,336, filed, Oct. 27, 1995, by Perlov et al., entitled "Continuous Processing System for Chemical Mechanical Polishing," and assigned to the assignee of the present invention, which is hereby incorporated by reference.

Figure 3A:
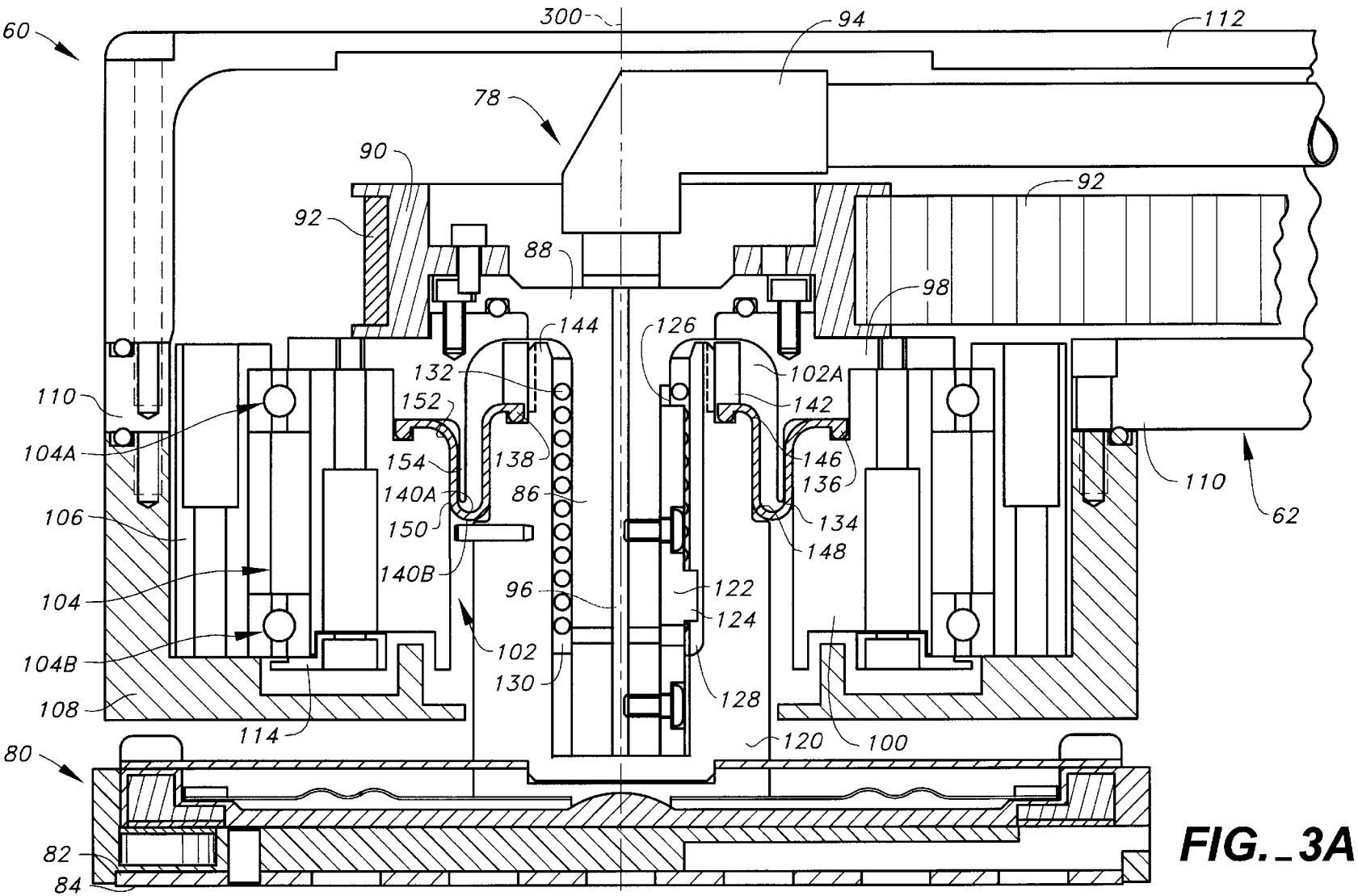
FIG. 3A is a diagrammatic cross-sectional view of a conditioner head with an end effector in a retracted position.
Figure 3B:
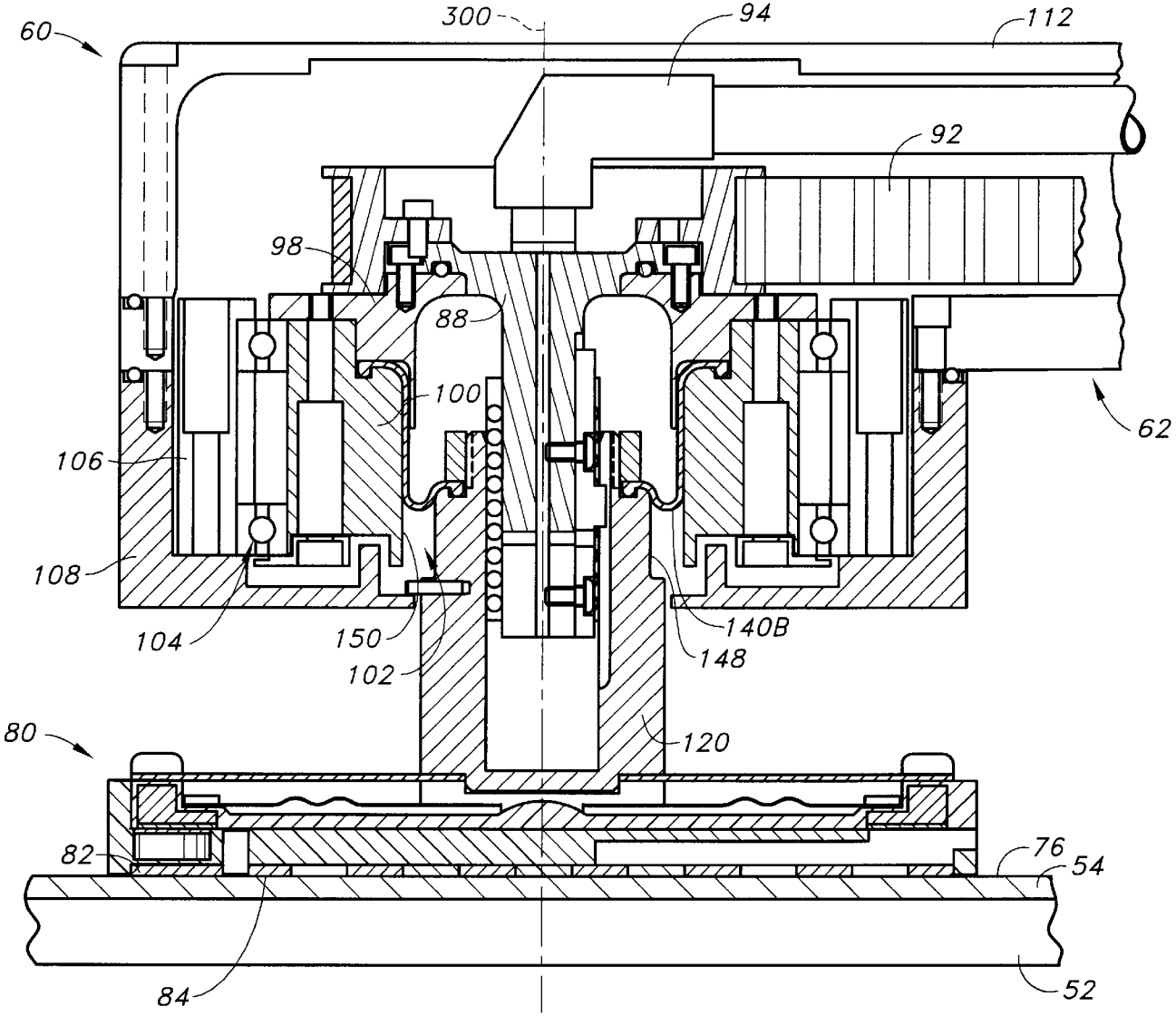
FIG. 3B is a diagrammatic cross-sectional view of a conditioner head with an end effector in an extended position.
Figure 9:
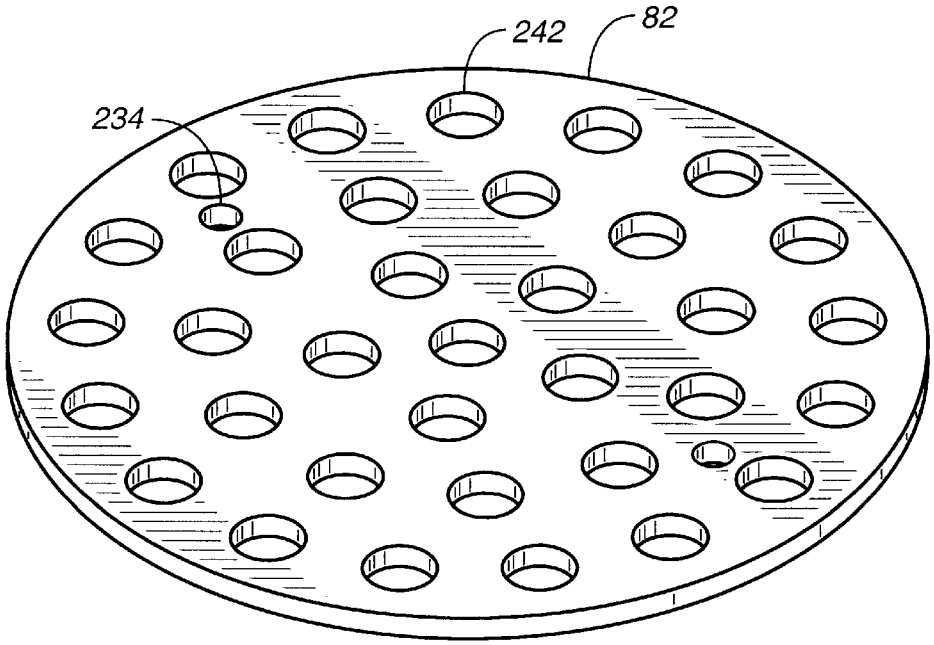
FIG. 9 is a perspective view of a conditioning disk of FIG. 4.
Figure 7B:
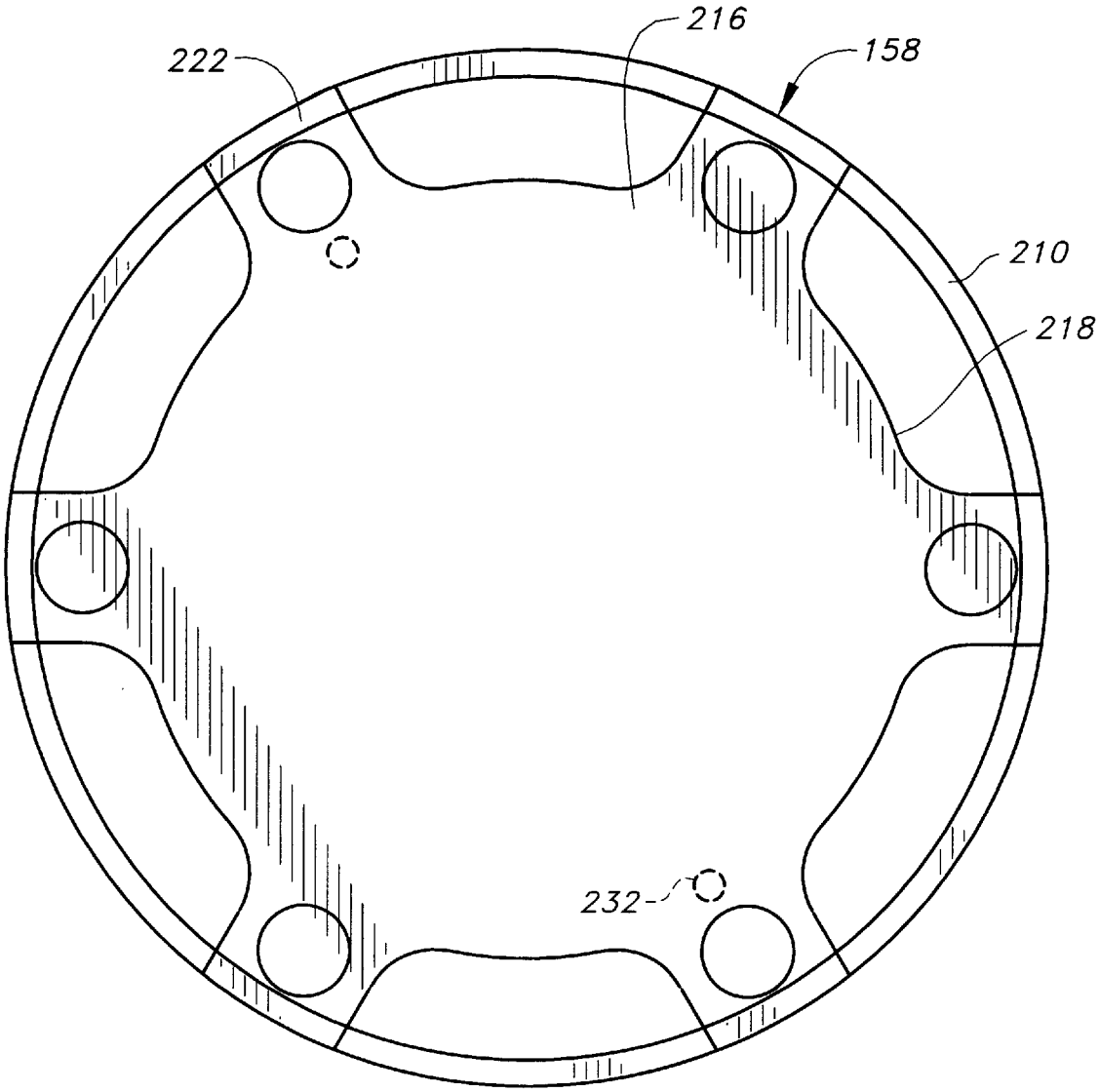
FIG. 7B is a top view of the disk holding member of FIG. 7A.
Figure 7C:
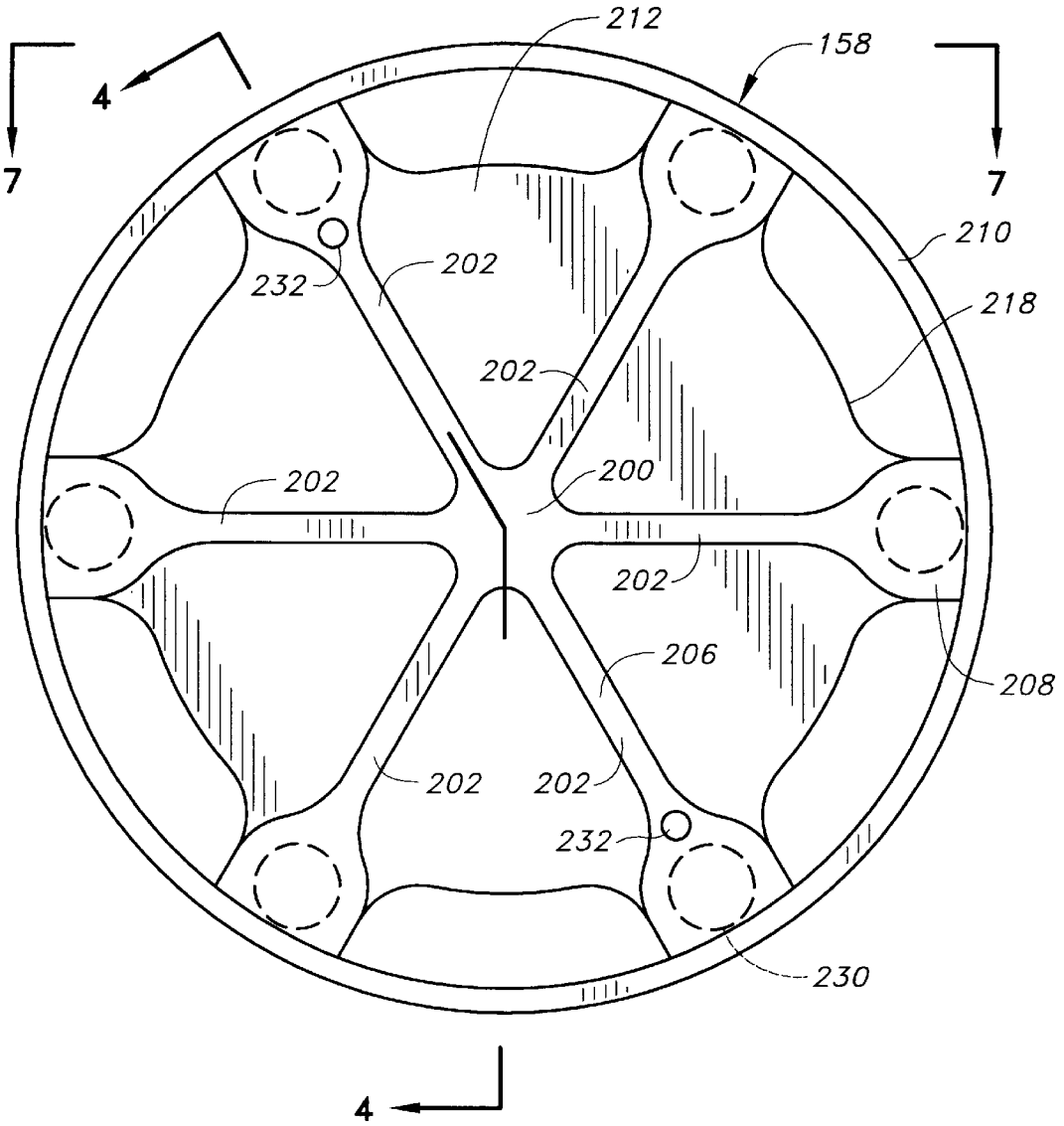
FIG. 7C is a bottom view of a disk holding member of FIG. 7A.
Figure 8:
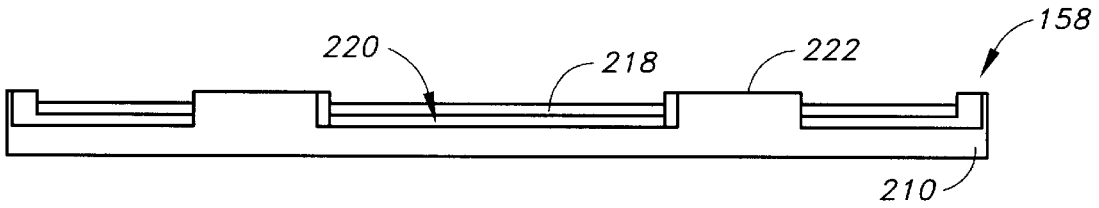
FIG. 8 is a side view of the disk holding member along line 8—8 of FIG. 7C.

Referring to FIGS. 3A and 3B, a conditioner head 60 includes an actuation and drive mechanism 78 which rotates an end effector 80 carrying a diamond impregnated conditioning disk 82 (see also FIG. 9) about a central vertically-oriented longitudinal axis 300 of the head. The actuation and drive mechanism further provides for the movement of the end effector 80 and disk 82 between an elevated retracted position (FIG. 3A) and a lowered extended position (FIG. 3B). In substantially the extended position, the lower surface 84 of the disk 82 may be brought into engagement with the polishing surface 76 of the pad 54. Additionally, the end effector may be introduced to the cup 66 (FIG. 2B) for cleaning the disk or the disk may be replaced, both of which are described in further detail below.

The actuation and drive mechanism 78 includes a vertically-extending drive shaft 86 which, at its upper end, includes a unitarily-formed, radially-extending web 88. In the exemplary embodiment, the drive shaft may be formed of heat treated 440C stainless steel. A pulley 90 is secured to the web and carries a belt 92 which extends along the length of the arm 62 and is coupled to a remote motor (not shown) for rotating the shaft 86 about the longitudinal axis 300. A rotary union 94 is secured to the upper end of the shaft for introducing and withdrawing air from an actuation chamber via a longitudinal channel 96 in the shaft. A collar, having upper and lower pieces 98 and 100, respectively, coaxially encompasses the shaft, defining a generally annular space 102 therebetween. The upper collar piece 98 is fired to arch depends from the web 88. In the exemplary embodiment, the pulley may be formed of aluminum and the collar may be formed of 303 stainless steel. Accordingly, the shaft, pulley, and collar form a generally rigid structure which rotates as a unit about the longitudinal axis 300. To permit rotation, the shaft/pulley/collar unit is carried within the head by a bearing system 104 comprising upper and lower ball bearing units 104A and 104B. The bearing system 104 couples the lower collar 100 of the collar piece to an inner head housing 106 which is fixed to the structure of the arm. An annular clamp 114 is secured to the base of lower collar piece 100 so as to vertically clamp an inner portion of the bearing system 104 between the clamp 114 and upper collar piece 98. The inner head housing 106 is held within a centrally-apertured cup-shaped outer head housing 108 and secured thereto to vertically clamp an outer portion of the bearing system 104 between the inner and outer head housings. The outer head housing 108 is secured to a lower arm housing 110 so that the arm 62 supports the head 60. An upper arm housing 112 provides additional structural support. In the exemplary embodiment, the inner and outer head housings may be formed of 303 and 316 stainless steel, respectively, and the clamp may be formed of 303 stainless steel.

A generally-annular drive sleeve 120 couples the end effector 80 to the drive shaft 86. The drive sleeve may be formed of 316 stainless steel. The drive sleeve 120 is accommodated within the annular space 102 between the collar and drive shaft. The drive sleeve 120 is keyed to the drive shaft 86 so as to permit relative longitudinal translation therebetween while preventing relative rotation. In the illustrated embodiment, this is achieved by a keying member 122 having an outwardly projected keying tab 124. The keying member 122 is secured within a vertical slot 126 in the periphery of shaft 86 and the tab 124 rides within a vertical slot 128 in the interior of sleeve 120 and interacts with the sides of the slot 128 to prevent relative rotation of the shaft and sleeve. Thus the shaft transmits torque and rotation from the pulley to the sleeve 120. To provide a smooth sliding vertical engagement between the drive shaft 86 and drive sleeve 120, a bearing having a cage 130 and a plurality of balls 132 is interposed between the inner cylindrical surface of the sleeve 120 and the outer cylindrical surface of the shaft 86.

A generally-annular elastomeric diaphragm 134 having an outer periphery 136 and an inner periphery 138 off an upper portion of the annular space 102 to form a pressure chamber 102A. The diaphragm has an upper surface 140A generally interior to the pressure chamber 102A and a lower surface 140B generally exterior to the pressure chamber. In an exemplary embodiment, the diaphragm is made of neoprene having a thickness of about 0.03 inches. Along its inner periphery 138, the diaphragm is sealingly secured between an upward facing shoulder of the drive sleeve 120 and a lower face an annular internally threaded clamp 142. The clamp 142 (which may be formed as a nut) is engaged to an externally threaded reduced diameter portion 144 at the upper end of the drive sleeve 120. In the exemplary embodiment, the clamp may be formed of 6061-T6 aluminum. The diaphragm extends radially outward from between the clamp and shoulder and then curves downward along a round 146 formed between the shoulder and a cylindrical outer surface portion 148 of the drive sleeve. The diaphragm disengages the circular cylindrical outer surface portion and continues radially outward, traversing a gap (the annular space 102) between the drive sleeve and the collar. Continuing and curving upwardly, the lower surface 140B of the diaphragm engages a circular cylindrical inner surface 150 of the lower collar piece 100 and extends upward therealong. The diaphragm wraps over a round 152 formed between the cylindrical inner surface 150 and an upward facing shoulder of the lower collar piece and is clamped between the upward facing shoulder and a downward facing shoulder of the upper collar piece 98. Inboard of the inner cylindrical surface 150, an annular lip 154 projects downward from the upper collar piece, sandwiching a portion of the diaphragm between an outer cylindrical surface of the lip 154 and the inner cylindrical surface 150 of the lower collar piece.

In operation, the chamber 102A may be inflated to move the drive sleeve 120 and end effector 86 from the retracted position (FIG. 3A) to the extended position (FIG. 3B). The chamber may be deflated, such as by applying a vacuum through the rotary union 94, move the drive sleeve and end effector from the extended position to the retracted position. Because gravity naturally biases the end effector and drive sleeve toward the extended position, vacuum is provided for retraction. During transition between the retracted and extended positions, the lower surface 140B of the diaphragm rolls off the cylindrical outer surface 148 of the drive sleeve, traverses the gap formed by annular space 102, and rolls onto the cylindrical inner surface 150 of the lower collar piece. The amount of downforce applied to the end effector will be proportional to the pressure applied to the chamber. Optionally, a spring (not shown) may be provided to bias the drive sleeve toward the retracted position and, thereby, eliminate or reduce the need for applying a vacuum to retract the end effector.

Figure 4:
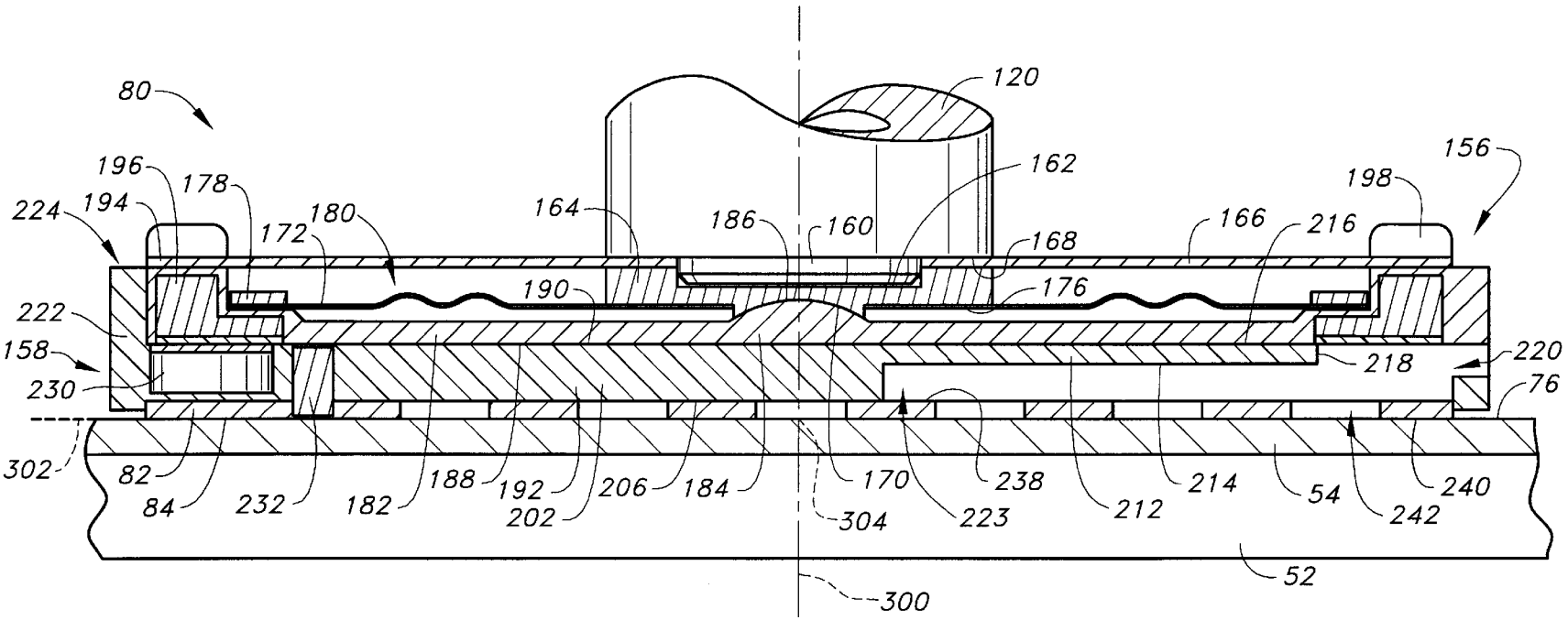
FIG. 4 is a diagrammatic cross-sectional view of the end effector of the conditioner head of FIGS. 3A and 3B.
Figure 5:
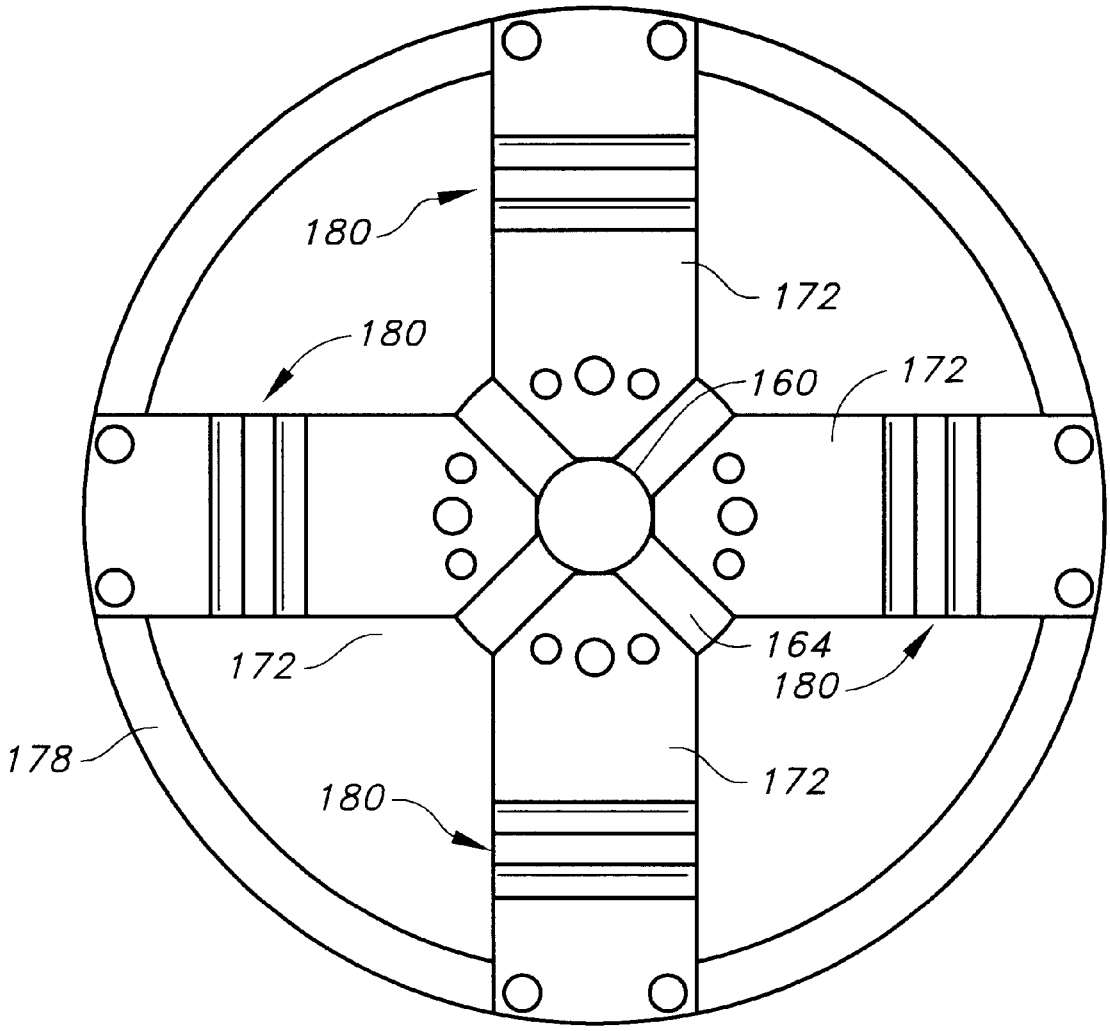
FIG. 5 is a top view of a flexure of the end effector of FIG. 4.

The drive sleeve couples the end effector to the drive shaft to transmit torque and rotation from the drive shaft and downforce from the pressure chamber to the end effector shown in FIG. 4. The end effector 80 includes a backing element 156 for transmitting the torque, rotation, and downward force to the conditioning disk 82. An optional removable disk holder 158 may intervene between the disk and the backing element. In the illustrated cross-sectional views, including FIG. 4, the section through the disk holder 158 is taken at an angle of 150° about the axis 300. The remainder of the head is sectioned by a plane. A central cylindrical projection 160 depends from the base of the drive sleeve 120 and is received by a cylindrical well 162 in a hub 164 of the backing element 156 and is secured thereto by means such as screws (not shown). A centrally-apertured annular elastomeric membrane cover 166 prevents contaminants from falling into the interior of the backing element. The cover 166 is clamped at its aperture between a horizontal shoulder 168 of the drive sleeve base and an annular surface of the top of the hub 164, outboard of the projection 160 and well 162. In the exemplary embodiment, the cover may be formed of ethylene propylene diene terpolymer (EPDM) rubber. A central downward facing socket 170 having a concave spherical surface portion is formed in the bottom of the hub 164. In the illustrated embodiment, the socket is a sector comprising approximately 63.5° degrees of arc. Extending radially outward from the hub 164 are four generally flat sheet-like spokes 172 (see also FIG. 5), each oriented so as to have generally upper and lower surfaces. At the proximal end of each spoke, the spoke's upper surface is in contact with an annular downward facing shoulder 176 of the hub 164 radially outboard of the socket 170. In the exemplary embodiment, the hub may be formed of 303 stainless steel. The spokes may be formed of 302 stainless steel with an exemplary thickness of 0.010 inches (0.25 mm). Each spoke's proximal end is secured to the hub 164 such as by rivets, screws, or other fastening means (not shown). The distal ends of the spokes are secured to an annular rim 178 which may be formed as a flat horizontal 303 stainless steel band to which the spokes are welded or otherwise secured.

With their low profile, the spokes 172 are resiliently flexible upward and downward so as to permit tilting of the rim, relative to the axis 300 from the otherwise neutral horizontal orientation. However, the configuration of the spokes makes them substantially inflexible transverse to the axis 300, so that they effectively transmit torque and rotation about the axis 300 from the hub 164 to the rim 178. Optionally, to increase vertical flexibility without compromising lateral strength and ability to transmit torque, the spokes may each be provided with a transversely extending wave or ruffle 180. In the exemplary embodiment, the wave extends two cycles, each cycle having a length of approximately 0.22 inches (5.6 mm) and an amplitude of approximately 0.04 inches (1.0 mm). Three to five spokes are preferred to balance torque transmission and flexibility.

Figure 6:
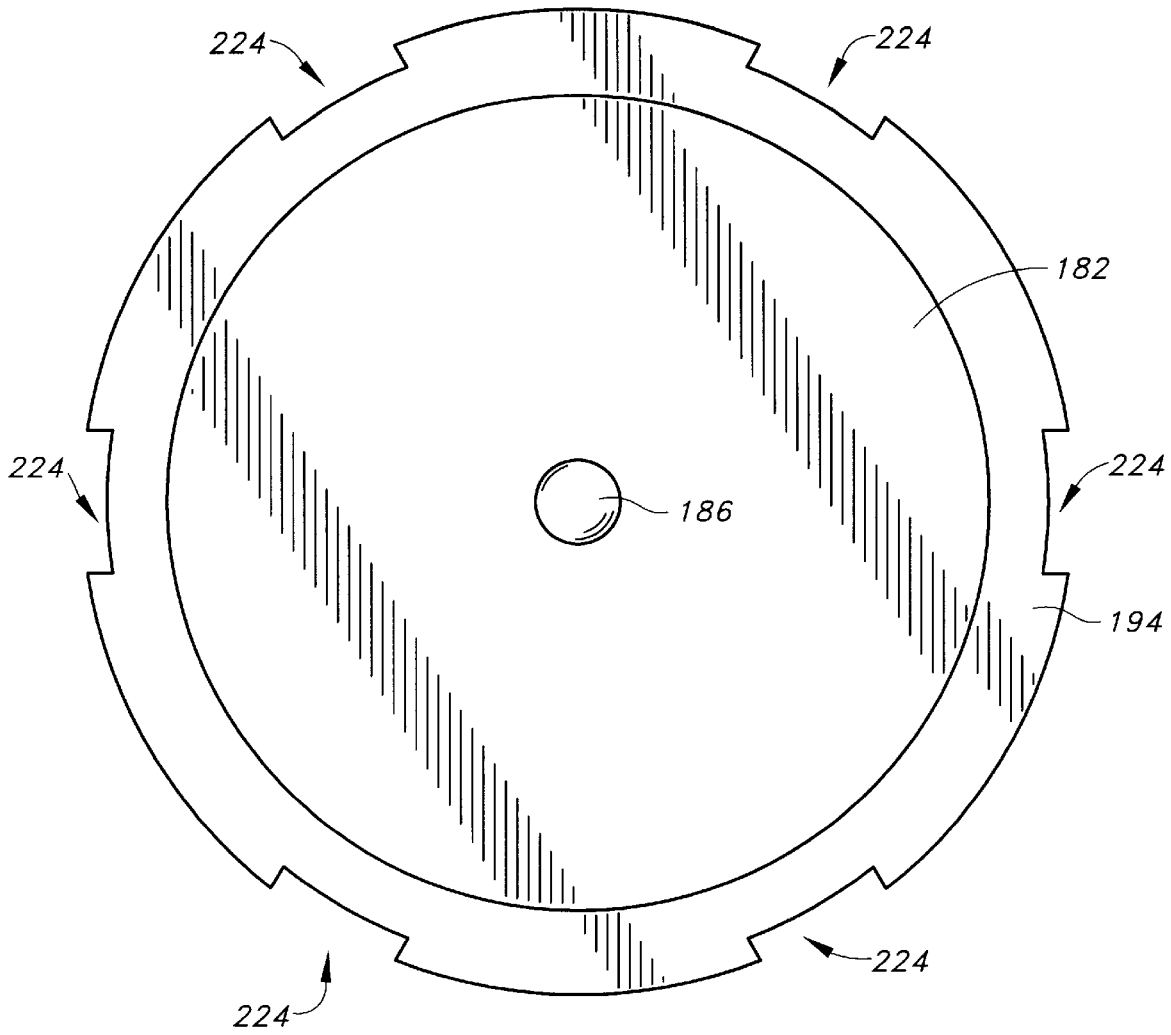
FIG. 6 is a top view of a backing plate of the end effector of FIG. 4.
Figure 7A:
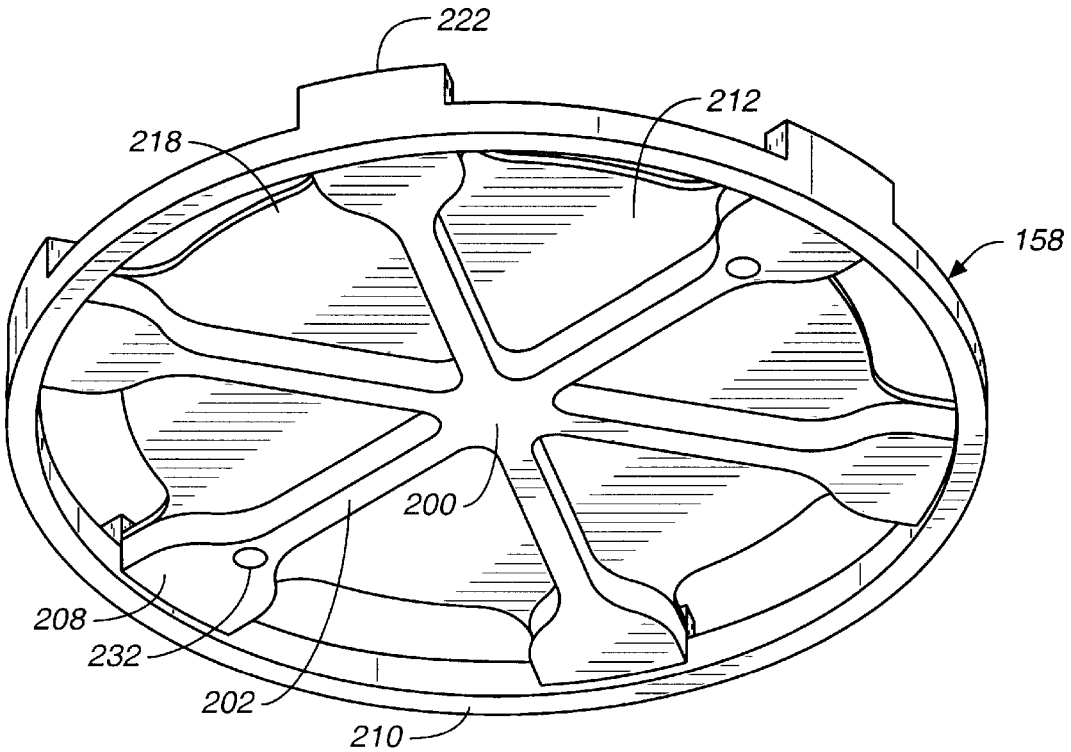
FIG. 7A is a top perspective view of a disk holding member of the end effector of FIG. 4.

Immediately below the spokes, the backing element includes a rigid, generally disk-shaped, polyethylene terepthalate (PET) backing plate 182. The backing plate has a central upward facing projection 184 having a convex spherical surface portion 186 (see also FIG. 6) of equal radius to and in sliding engagement with the concave spherical surface portion of the socket 170. Interaction of the projection 184 and socket 170 can transmit compressive force between drive sleeve 120 and backing element 156 while permitting the backing element to rotate about axes orthogonal to the axis 300. The backing plate 182 has a generally flat lower surface 188 in contact with an upper surface 190 of a body 192 of the disk holder 158. The plate 182 extends radially outward to a generally annular rim section 194. The rim section 194 is secured to the band 178 such as by screws extending through the band. The rim section 194 is also secured to the outer periphery of the cover 166 such as by screws extending through a clamp ring 198 clamping the cover 166 to the rim 194. The plate rim 194 carries a generally-annular L-sectioned stainless steel ring 196 in an annular upwardly directed pocket. The pocket is sealed with a PET plug which is flush with the lower surface 188 of the backing plate 182.

The disk holder 158, shown in FIG. 4 and in isolated perspective, top, bottom and side views in FIGS. 7A, 7B, 7C and 8, respectively, has a central core or hub region 200 from which radiate six radially-extending spokes 202. Each spoke has substantially flat lower surface 206. Each spoke has a relatively narrow section extending outward from the core and diverging to form a relatively wide section 208 adjacent an outer perimeter rim 210. In the illustrated embodiment, the rim 210 is formed as a generally annular band. A web 212 is formed between each adjacent pair of spokes 202. Each web extends from the core 200 and terminates at an outboard edge 218 which is radially recessed from the rim 210. Each web has a lower surface 214 which is vertically recessed from the lower surfaces of adjacent spokes. Each web also has a flat upper surface that is substantially coplanar with the upper surfaces of the adjacent spokes to form an upper surface 216 of the disk holder which contacts the lower surface 188 of the backing plate. Alternatively, the upper surface 216 of each web may be slightly recessed from the upper surface of the spoke to reduce the effects of slurry trapped between the disk holder and backing element. Associated and aligned with each web 212 is a downwardly extending recess 220 (FIGS. 4 and 7) in the upper edge of the rim 210. Between each recess 220, the rim 210 includes a projection 222 at the outer end of each spoke 202. The projections 222 extend above the upper surfaces of the spokes. As shown in FIG. 4, when the disk holder is engaged to the backing plate, each projection 222 is received by a corresponding recess or cutout 224 in the rim 194 of the backing plate 182 (see FIG. 6). The projections 222 fit securely within the recesses 224 to prevent relative rotation of the disk holder and backing element. Radially outward extending channels 223 are each defined by an adjacent pair of the spokes 202, the lower surface 214 of the web 212 between such pair of spokes, and the upper surface 238 of the disk 82. The role of these channels is described in further detail below.

In the illustrated embodiment, the core 200, spokes 202, webs 212, and rim 210 are unitarily formed, preferably as a single molding of a polymer material such as PET.

A cylindrical blind bore is formed in the wide section of each spoke 202 adjacent the rim 210. The bore accommodates a cylindrical magnet 230 and is plugged by a polyethylene terepthalate (PET) cylinder. In the illustrated embodiment, the bore extends down from the upper surface 204 of the spoke, and the cylinder is flush with the upper surface of the spoke. Magnetic attraction between the magnets 230 and the ring 196 vertically secures the disk holder to the backing element by magnetic attraction.

In each spoke of one diametrically opposed first pair of spokes, a drive pin 232 depends from the spoke immediately inboard of the magnet 230. When the disk holder is mated to the disk 82, the drive pins are received by associated bores 234 in the disk and serve to prevent rotation of the disk relative to the disk holder. The disk 82 (see also FIG. 9) may be formed of nickel-coated carbon steel having the lower surface 84 embedded with diamond particles for an abrasive. The magnets attract the disk, vertically securing the disk to the holding element with the upper surface 238 of the disk contacting the lower surfaces of the spokes 202.

The flat lower surface 84 of the disk defines a disk plane 302. In a neutral orientation, the disk plane is perpendicular to the longitudinal axis 300 which extends through the center of the disk. The concave and convex spherical surface portions of socket 170 and projection 184, respectively, have a common center of curvature 304 at the intersection of the disk plane 302 with the longitudinal axis 300. In operation, with the conditioner head located above the polishing pad as described above, the drive shaft 86 is caused to rotate, which rotation is transmitted to the disk 82. The end effector 80 is then shifted from the retracted position to an extended position to bring the lower surface 84 of the disk into engagement with the polishing surface 76 of the pad. The downward force compressing the disk against the pad is controlled by modulating the pressure in the pressure chamber 102A. The downward force is transmitted through the drive sleeve, the hub, between the concave and convex spherical surface portions to the backing plate, to the disk holder, and then to the disk. Torque to rotate the disk relative to the pad is supplied from the drive shaft to the drive sleeve, the hub, the spokes, the rim of the backing element, the holder, and then to the disk via the pins.

Figure 10:
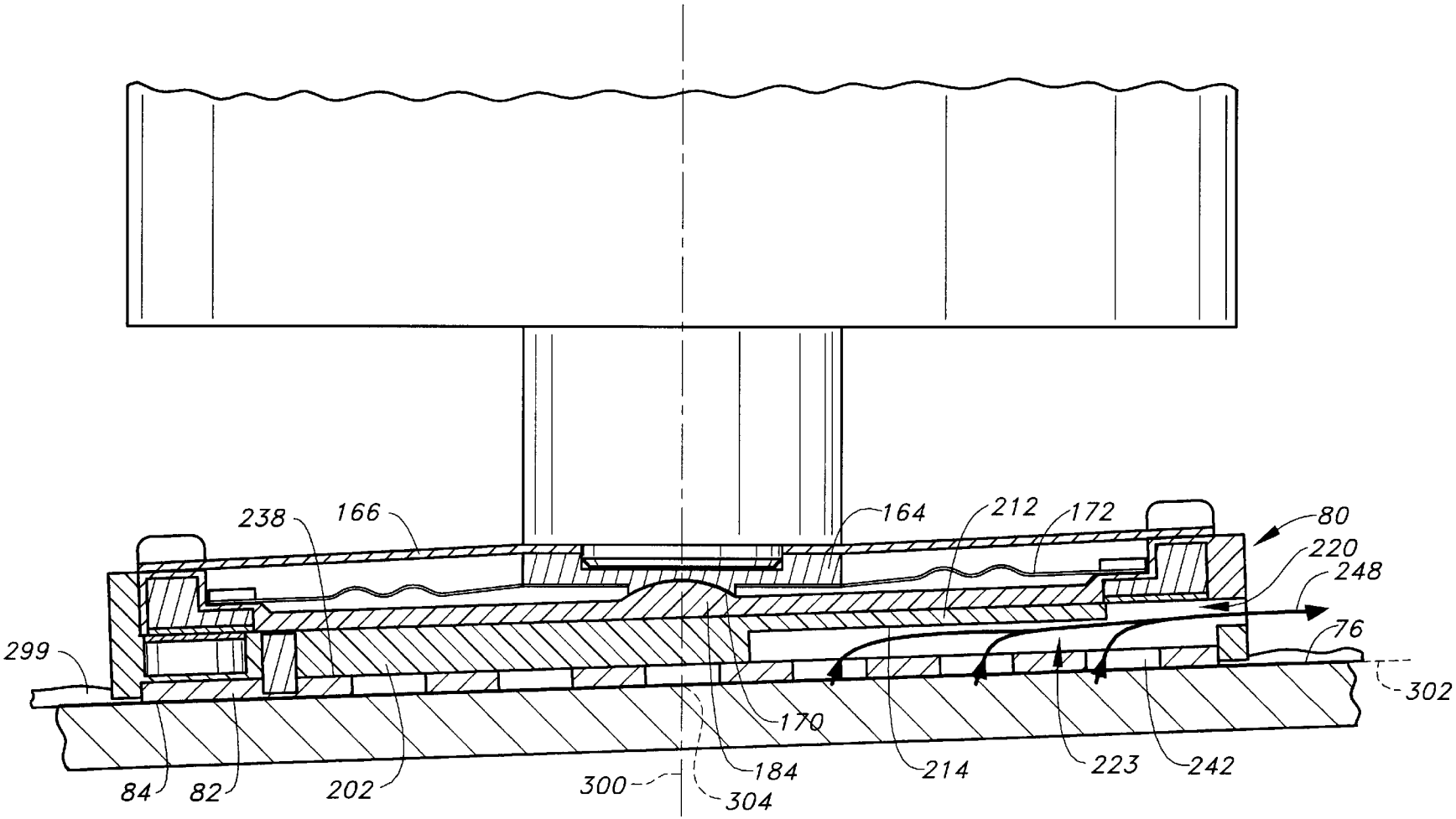
FIG. 10 is a diagrammatic cross-sectional view of a conditioner head with an end effector tilted to engage a polishing pad.

Precise perpendicular alignment between the axis 300 and the polishing surface 76 of the pad is not easily provided. Because of this, it is desirable that at least the disk be able to tilt to maintain its lower surface flat against the polishing surface of the pad as shown in FIG. 10. If the polishing surface of the pad is not perpendicular to the axis 300, the disk, disk holder and backing element may tilt relative to the axis via sliding of the convex spherical surface of the projection 184 relative to the concave spherical surface of the socket 170. The hub 164 remains fixed relative to the axis 300. To accommodate the tilt, the spokes 172 flex either upward or downward depending on their location at any given point in time. The location of the common center 304 in disk plane 302 minimizes fluctuations in the compression force between the disk and the pad when the end effector 80 tilts to maintain engagement between the end effector and pad. The shear force applied to the disk by friction with the polishing pad is directed in the disk plane 302 and, thereby, does not exert a moment about the center 304 which would otherwise tend to pivot the disk and produce an uneven pressure distribution between the disk and pad. The cover 166 is free to flex and stretch to accommodate the tilting.

In operation, the lower surface of the rotating conditioning disk 82, engaged with the polishing surface of the rotating polishing pad, is reciprocated in a path along the rotating polishing pad as described above. During this process, the bottom surface of the disk is immersed in the thin layer of a polishing slurry 299 atop the polishing pad. The rotation of the disk may induce a flow 248 of the polishing slurry longitudinally upward from the lower surface 84 of the disk, through an array of holes 242 in the disk, and radially outward along the upper surface of the disk through the channels 223. The flow proceeds outward through radially-extending passageways in the rim 210 formed by the recesses 220. Each passageway/recess 220 is generally aligned with an associated channel 223. This flow of the slurry may increase the effectiveness of conditioning by helping to evacuate material from the pad surface.

Figure 11:
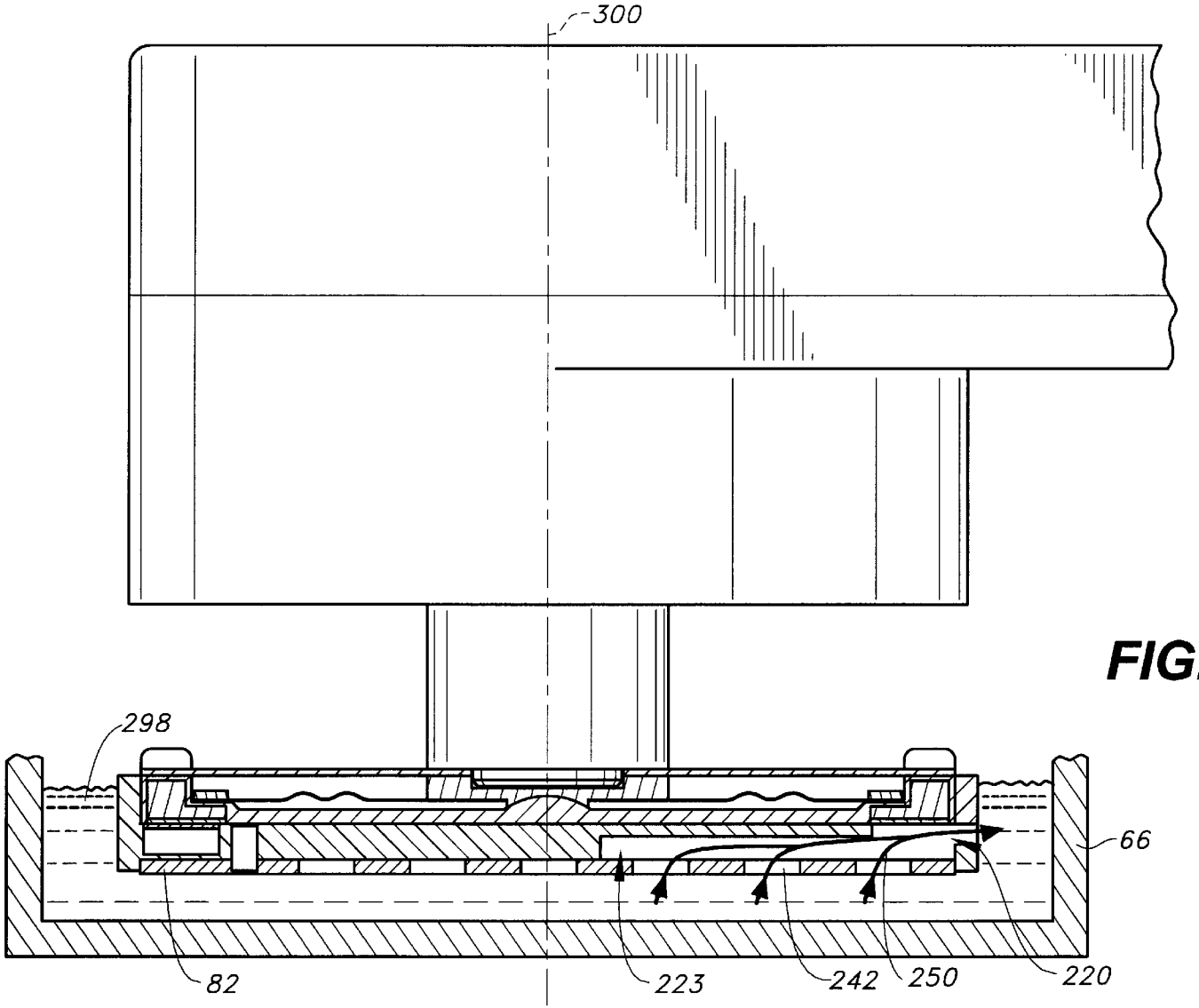
FIG. 11 is a diagrammatic cross-sectional view of a conditioner head with an end effector immersed in a cup of cleaning liquid.

As shown in FIG. 11, for cleaning the disk 82, the end effector is raised, causing the disk to disengage from the polishing pad. The cup 66 may then be pivoted to a location below the head and the end effector extended so as to immerse the disk in a cleaning liquid 298 in the cup. The disk is rotated about the axis 300 within the body of cleaning liquid (the rotation need not have been altered since the disk was engaged to the pad). The rotation causes a flow 250 of the cleaning liquid longitudinally upward from the lower surface of the disk, through the holes 242, through the disk, and radially outward along the upper surface of the disk through the channels 223. Flow of the cleaning liquid, which may comprise deionized water, serves to clean the disk of contaminants including material worn from the pad, byproducts of the polishing etc.

A number of embodiments of the present invention have been described. Nevertheless, it will be understood that various modifications may be made without departing from the spirit and scope of the invention. For example, various features may be adapted for use with a variety of existing or future conditioner and polisher configurations other than those specifically shown. Although the exemplary end effector is shown constructed with particular components, various of the components may be combined or further subdivided. Additionally, various elements of these components or their subcomponents and their associated functions may be shifted to other components. Accordingly, other embodiments are within the scope of the following claims.

What is claimed is:

1. A disk holder for holding a conditioning disk for conditioning a polishing pad, comprising:

a lower face for engaging an upper surface of the conditioning disk and defining a plurality of generally radially outward extending channels along the upper surface of the conditioning disk.

2. The disk holder of claim 1 further comprising:

a central region;

an outer perimeter;

a plurality of radially extending spokes, extending from the central region to the outer perimeter, each said spoke having a lower surface for engaging the upper surface of the conditioning disk; and a plurality of webs, one such web between each adjacent pair of said spokes, each web having a lower surface at least partially vertically recessed from the lower surfaces of the adjacent spokes so as to define one said channel.

3. The disk holder of claim 2 wherein each web extends from the central region and terminates at an outboard edge, radially recessed from the outer perimeter.

4. The disk holder of claim 3 wherein the outer perimeter is formed as a rim and wherein the rim has a plurality of radially extending passageways, each passage generally aligned with an associated one of the channels for permitting flow radially outward through the passageway from the associated channel when the disk holder and disk are rotated about a central longitudinal axis while at least a lower surface of the disk is exposed to a liquid.

5. The disk holder of claim 4 wherein each of the radially extending passageways is formed as a downwardly extending recess in the rim.

6. The disk holder of claim 2 wherein the conditioning disk is readily securable to and removable from the disk holder and each spoke carries a magnet for attracting the conditioning disk.

7. The disk holder of claim 2 wherein the conditioning disk is readily securable to and removable from the disk holder, and the disk holder is readily securable to and removable from a rotating fixture wherein each spoke carries a magnet for securing the conditioning disk to the disk holder and for securing the disk holder to the rotating fixture.

8. The disk holder of claim 2 further comprising a first pin depending from a first one of said spokes and a second pin depending from a second one of said spokes, the first and second pins receivable by the conditioning disk for preventing rotation of the conditioning disk relative to the disk holder.

9. The disk holder of claim 2 wherein the central region, outer perimeter, said spokes and said webs are unitarily formed as a single piece of material.

10. The disk holder of claim 9 wherein each one of said spokes has a relatively narrow section extending outward from the central region and joining a relatively wider section adjacent the outer perimeter.

11. The disk holder of claim 9 wherein each one of said webs has an upper surface, substantially coplanar with the upper surfaces of adjacent ones of said spokes.

* * * * *